US009634434B1

(12) United States Patent
Pao et al.

(10) Patent No.: US 9,634,434 B1
(45) Date of Patent: Apr. 25, 2017

(54) ELECTRICAL CONNECTOR AND DIFFERENTIAL SIGNAL ASSEMBLY THEREOF

(71) Applicant: TOPCONN ELECTRONIC (KUNSHAN) CO., LTD, Suzhou, Jiangsu Province (CN)

(72) Inventors: Chung-Nan Pao, New Taipei (TW); Yu-Feng Ke, Taoyuan County (TW); Sun-Yu Chou, New Taipei (TW); Wei Wang, Suzhou (CN)

(73) Assignee: TOPCONN ELECTRONIC (KUNSHAN) CO., LTD., Suzhou, Jiangsu Province (CN)

( * ) Notice: Subject to any disclaimer, the term of this patent is extended or adjusted under 35 U.S.C. 154(b) by 0 days.

(21) Appl. No.: 15/229,571

(22) Filed: Aug. 5, 2016

(30) Foreign Application Priority Data

Apr. 7, 2016 (CN) ..... 201610213947

(51) Int. Cl.
*H01R 9/05* (2006.01)
*H01R 13/6471* (2011.01)

(52) U.S. Cl.
CPC ..... *H01R 13/6471* (2013.01)

(58) Field of Classification Search
CPC H01R 13/6471; H01R 13/514; H01R 13/405; H01R 12/724
USPC ..... 439/607.05
See application file for complete search history.

(56) References Cited

U.S. PATENT DOCUMENTS 8,535,069 B2 * 9/2013 Zhang ..... H01R 13/6471 439/108
2009/0011655 A1 * 1/2009 Amleshi ..... H01R 13/6471 439/668
2013/0171885 A1 * 7/2013 Zhang ..... H01R 13/6471 439/676

* cited by examiner

*Primary Examiner* — Jean F Duverne
(74) *Attorney, Agent, or Firm* — Li & Cai Intellectual Property (USA) Office

(57) ABSTRACT

A differential signal assembly includes two pairs of differential signal wafers arranged in one row. Each differential signal wafer includes a plurality of mating portions arranged in one column and a plurality of mounting portions arranged in one column. In one of the two pairs of differential signal wafers, each differential signal wafer has a grounding pin and an offset grounding pin respectively arranged at two opposite ends of the column of mounting portions thereof, each offset grounding pin has an offset with respect to the corresponding column of mounting portions, the two distal ends of the mounting portions of each differential signal wafer are two signal mounting portions, cooperating with the two signal mounting portions of the other differential signal wafer. Thus, the grounding pin and the offset grounding pin of each differential signal wafer are configured to shield the adjacent signal mounting portions.

20 Claims, 14 Drawing Sheets

ELECTRICAL CONNECTOR AND DIFFERENTIAL SIGNAL ASSEMBLY THEREOF

BACKGROUND OF THE INVENTION

1. Field of the Invention

The instant invention relates to a connector; in particular, to an electrical connector and a differential signal assembly thereof for reducing signal interference in high frequency.

2. Description of Related Art

With the development of computers and peripheral equipment, the electrical connector has been an important medium for data transmission between the computer and peripheral equipment. Moreover, the transmission speed of the electrical device has grown higher and higher, such that the data transmitting speed of the electrical connector must be increased. However, if the electrical connector is used to transmit data in high speed, the terminals of two coupling electrical connectors will easily generate a signal interference in high frequency, such that the signal interference will influence the transmission performance of the coupling electrical connectors in high frequency or in high speed and further influence the normal operation of the corresponding electrical device (e.g., cellphone, laptops, tablet PCs, desktop computers, digital television, and so on). Accordingly, how to produce a better electrical connector for transmitting data in high speed and reducing a signal interference in high frequency has become an important subject.

SUMMARY OF THE INVENTION

The instant disclosure provides an electrical connector and a differential signal assembly thereof for effectively solving the signal interference problem generated from the conventional electrical connector.

The instant disclosure provides an electrical connector, comprising: an insulating case defining a length direction; and a differential signal assembly including two pairs of differential signal wafers arranged in one row parallel to the length direction, wherein the differential signal wafers are installed to the insulating case, and each differential signal wafer includes a plurality of mating portions inserted into the insulating case and a plurality of mounting portions arranged in one column; wherein in one of the two pairs of differential signal wafers, each differential signal wafer includes an offset grounding pin arranged at one end of the column of mounting portions thereof and having an offset with respect to the column of mounting portions thereof, the two distal mounting portions of each differential signal wafer are defined as two signal mounting portions cooperating with the two signal mounting portions of the other differential signal wafer to transmit differential signal; wherein in the other pair of differential signal wafers, the two distal mounting portions of each differential signal wafer are defined as two grounding mounting portions; wherein in two adjacent differential signal wafers arranged in middle of the two pairs of the differential signal wafers, the two signal mounting portions of one of the differential signal wafers are respectively arranged at one side of the two grounding mounting portions of the other differential signal wafer, and each signal mounting portion and the adjacent grounding mounting portion are arranged in one row parallel to the length direction.

The instant disclosure also provides a differential signal assembly of an electrical connector, comprising: two pairs of differential signal wafers arranged in one row parallel to a length direction, wherein each differential signal wafer includes a plurality of mating portions arranged in a column parallel to a height direction perpendicular to the length direction and a plurality of mounting portions arranged in one column parallel to a width direction perpendicular to the length direction and the height direction; wherein in one of the two pairs of differential signal wafers, each differential signal wafer includes an offset grounding pin arranged at one end of the column of mounting portions thereof and having an offset with respect to the column of mounting portions thereof, the two distal mounting portions of each differential signal wafer are defined as two signal mounting portions cooperating with the two signal mounting portions of the other differential signal wafer to transmit differential signal; wherein in the other pair of differential signal wafers, the two distal mounting portions of each differential signal wafer are defined as two grounding mounting portions; wherein in two adjacent differential signal wafers arranged in the middle of the two pairs of the differential signal wafers, the two signal mounting portions of one of the differential signal wafers are respectively arranged at one side of the two grounding mounting portions of the other differential signal wafer, and each signal mounting portion and the adjacent grounding mounting portion are arranged in one row parallel to the length direction.

In summary, the offset grounding pin (and the grounding pin) of the differential signal wafer are arranged corresponding in position to the column of the mounting portions to shield the two distal signal mounting portions, such that when the two distal signal mounting portions of each differential signal wafer and the two distal signal mounting portions of the adjacent differential signal wafer are coupling to transmit differential signal, the offset grounding pins (and the grounding pins) shield the distal signal mounting portions, thereby reducing a signal interference and improving a high-frequency transmitting efficiency.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

Please refer to FIGS. 1 through 15, which show an embodiment of the instant disclosure. References are hereunder made to the detailed descriptions and appended drawings in connection with the instant invention. However, the appended drawings are merely shown for exemplary purposes, rather than being used to restrict the scope of the instant invention.

Figure 1:
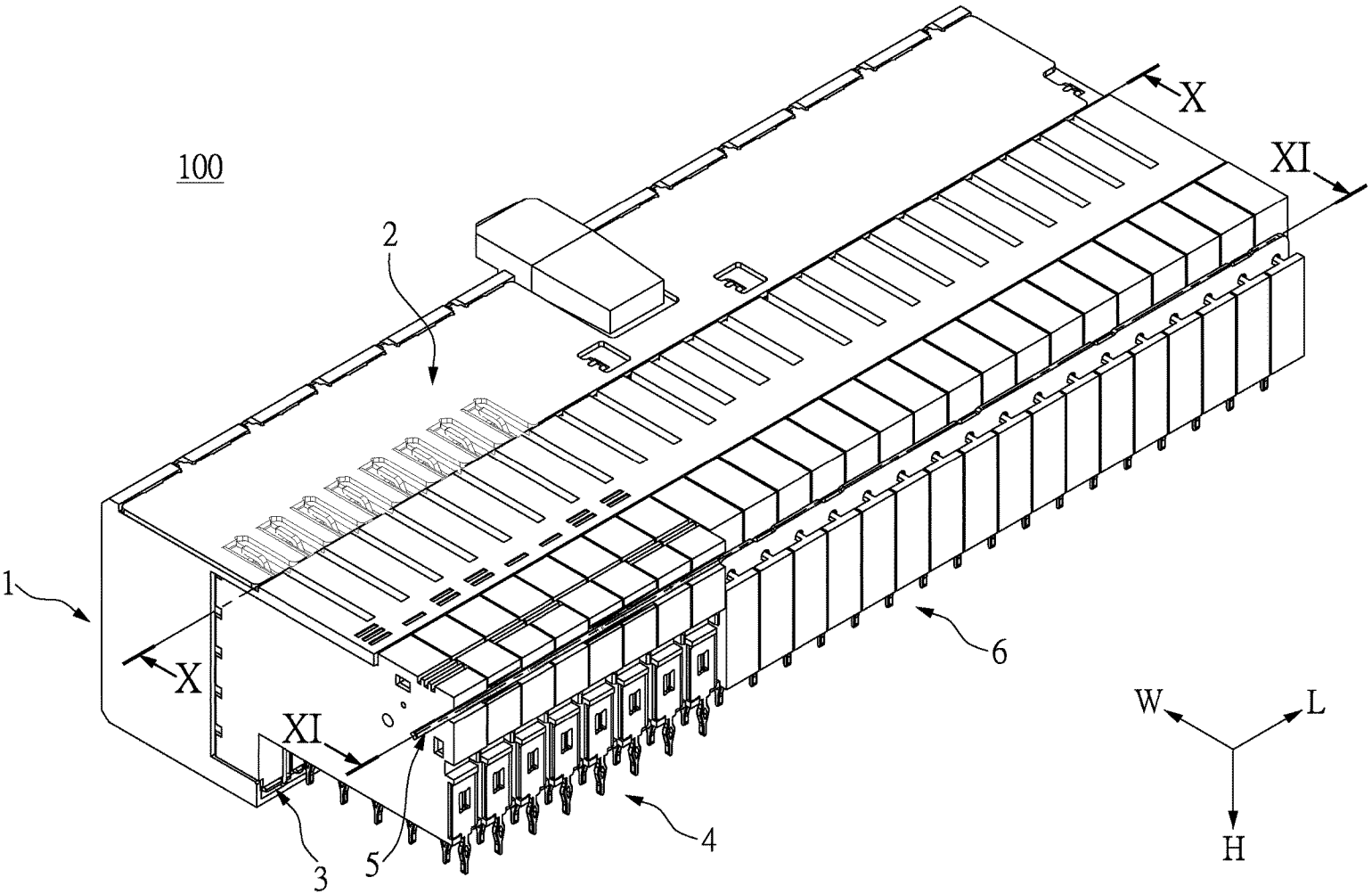
FIG. 1 is a perspective view showing an electrical connector according to the instant disclosure.
Figure 2:
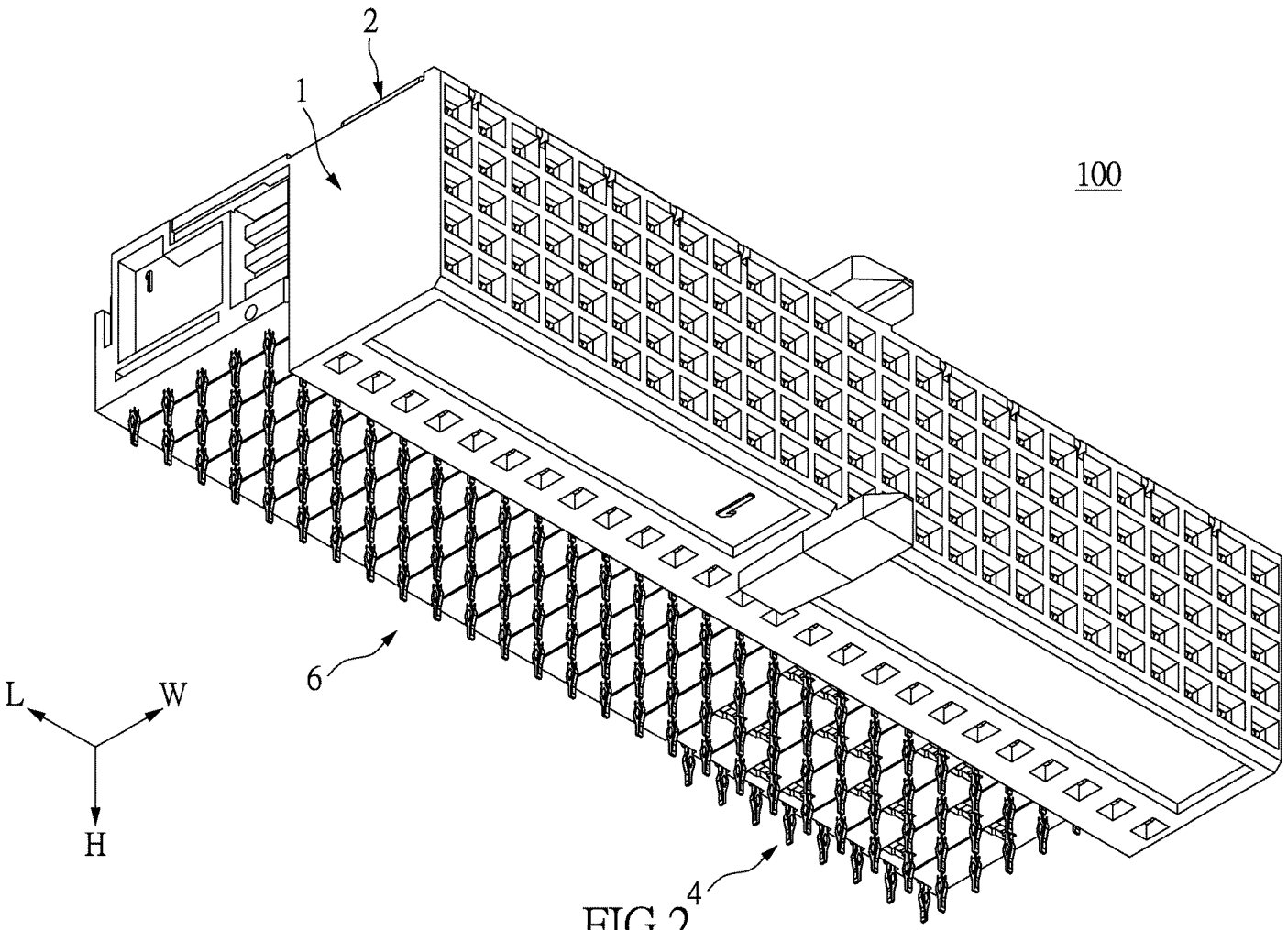
FIG. 2 is a perspective view of FIG. 1 from another perspective.

Please refer to FIGS. 1 and 2, which show an electrical connector 100 for transmitting a signal in high frequency and/or in high speed, but the instant disclosure is not limited thereto. The electrical connector 100 includes an insulating case 1, a shielding sheet 2 disposed on the insulating case 1, a beam 3 arranged in the insulating case 1, a differential signal assembly 4 installed to the insulating case 1, a bridge 5 inserted into the differential signal assembly 4, and a single-ended signal assembly 6 installed to the insulating case 1. The shielding sheet 2, the beam 3, and the bridge 5 are preferably made of conductive material (e.g., metal), but are not limited thereto.

Figure 3:
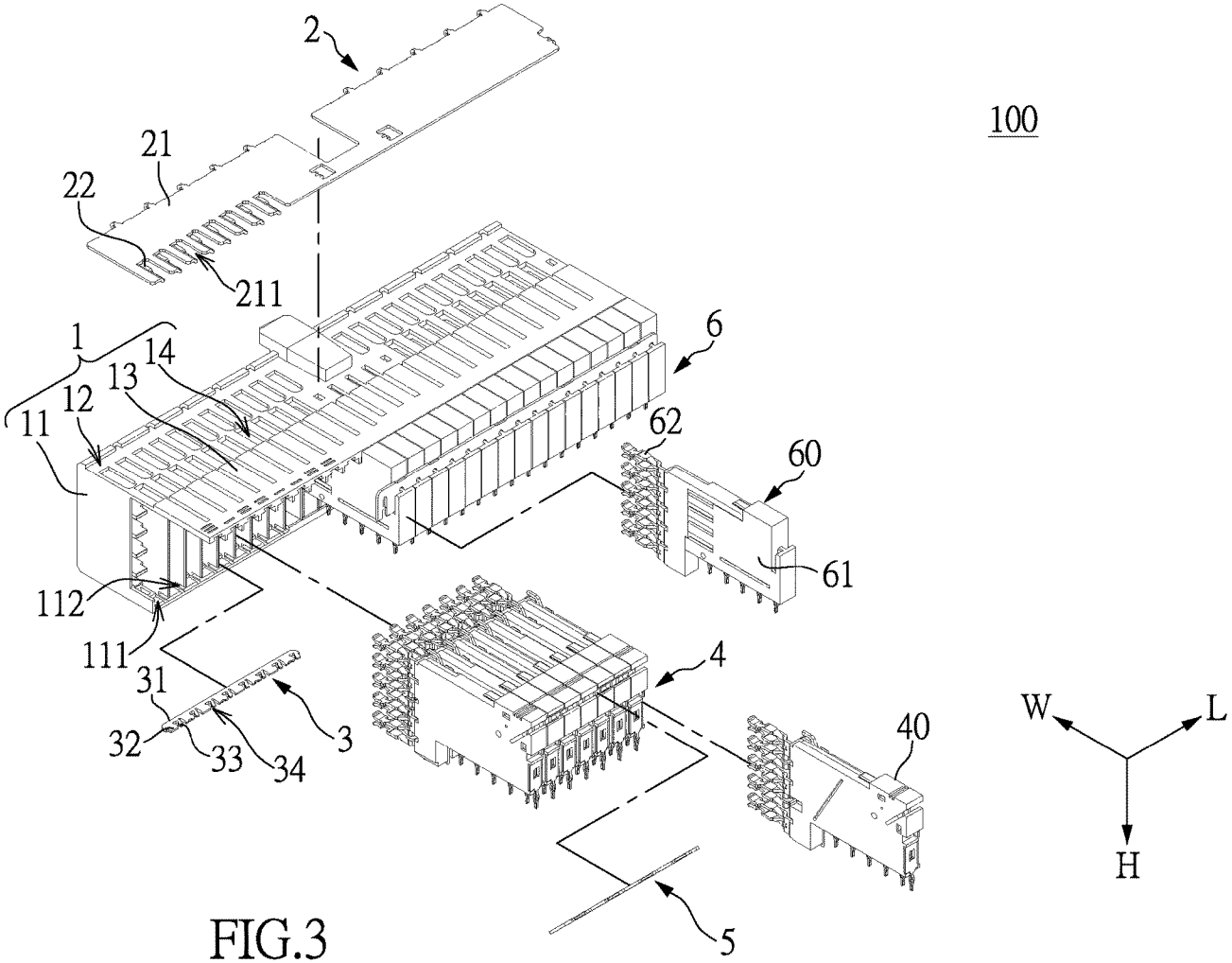
FIG. 3 is an exploded view of FIG. 1.
Figure 4:
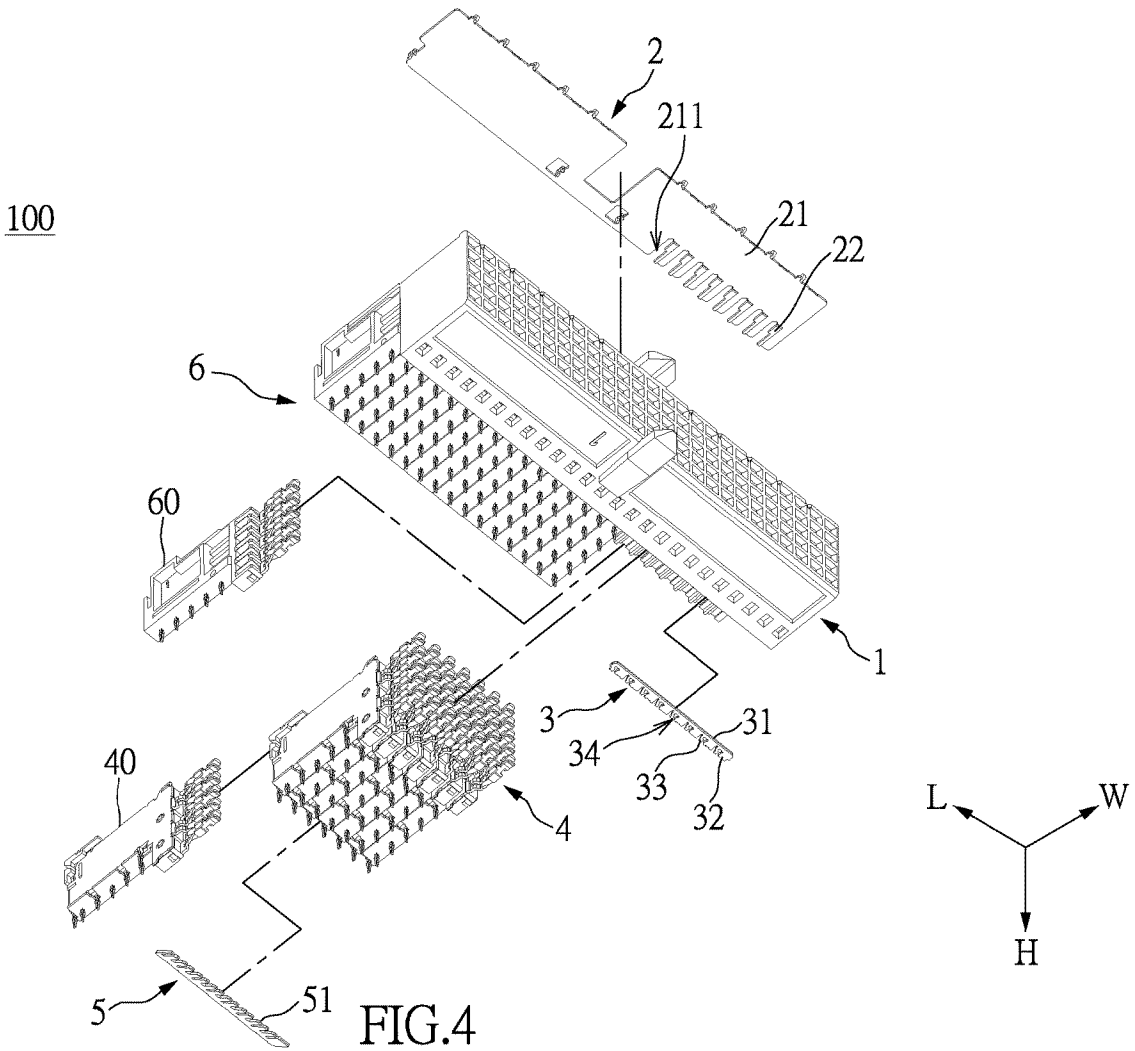
FIG. 4 is an exploded view of FIG. 2.
Figure 5:
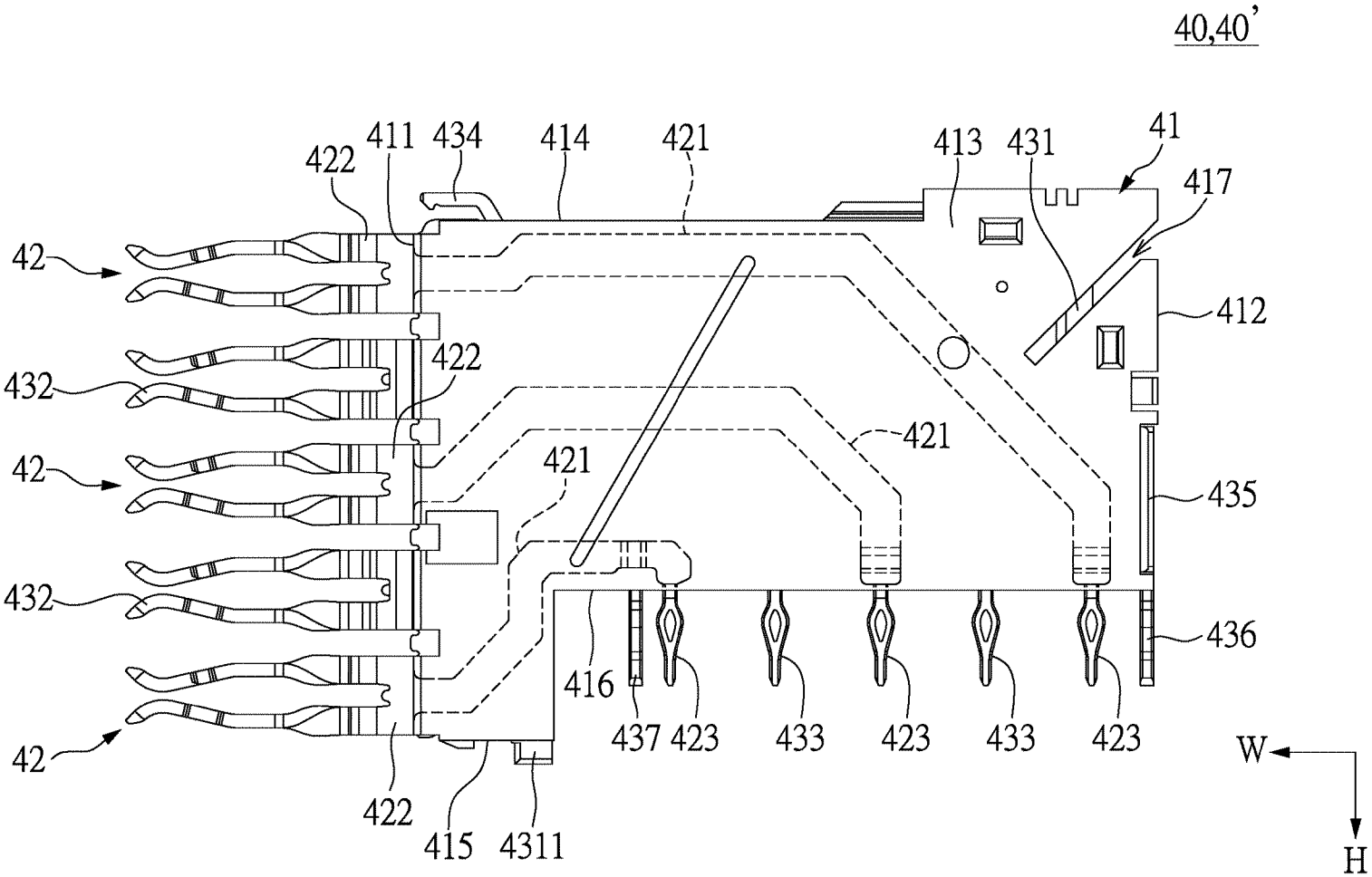
FIG. 5 is a plan view showing one kind of differential signal wafers according to the instant disclosure.
Figure 6:
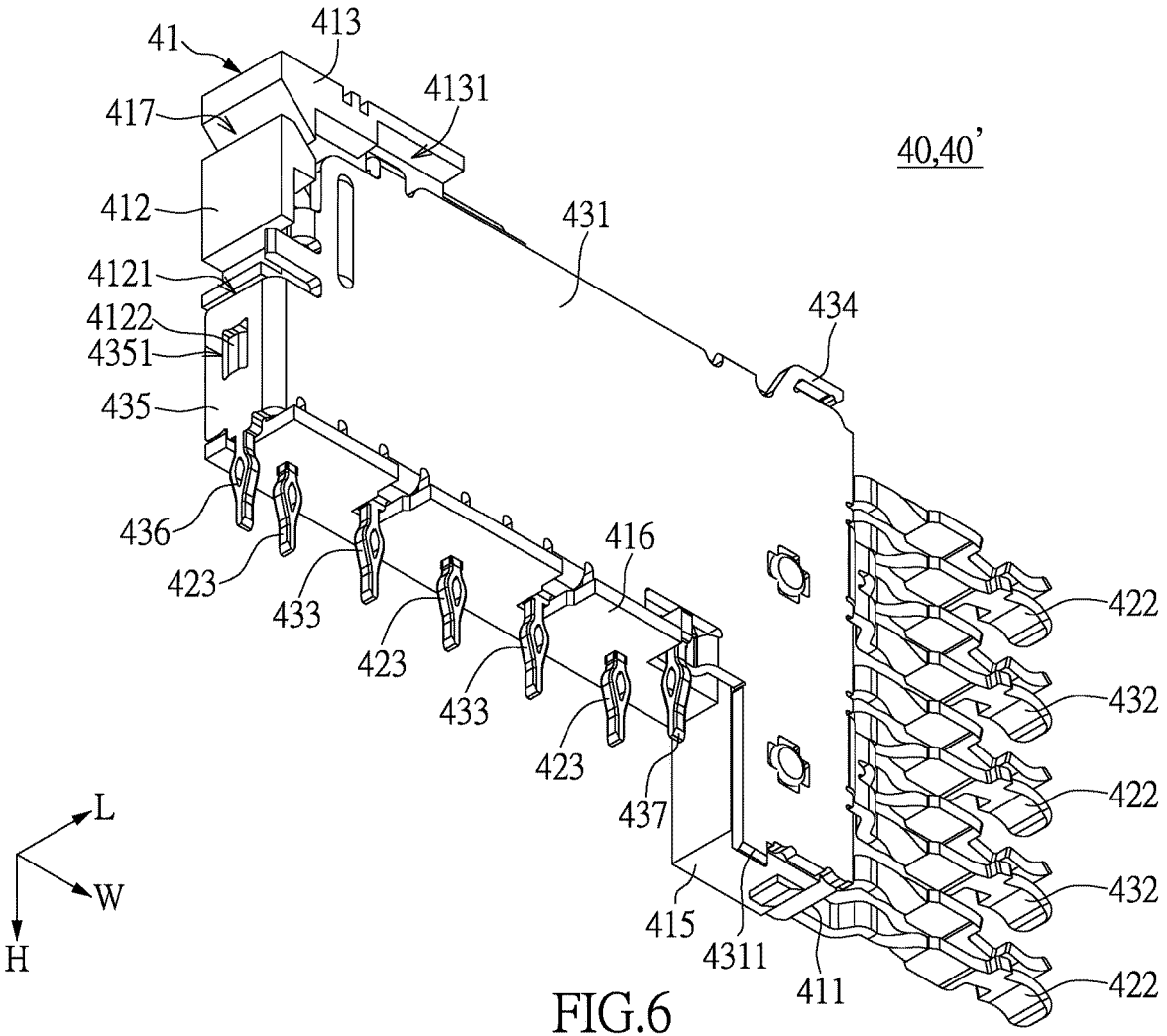
FIG. 6 is a perspective view of FIG. 5 from another perspective.
Figure 7:
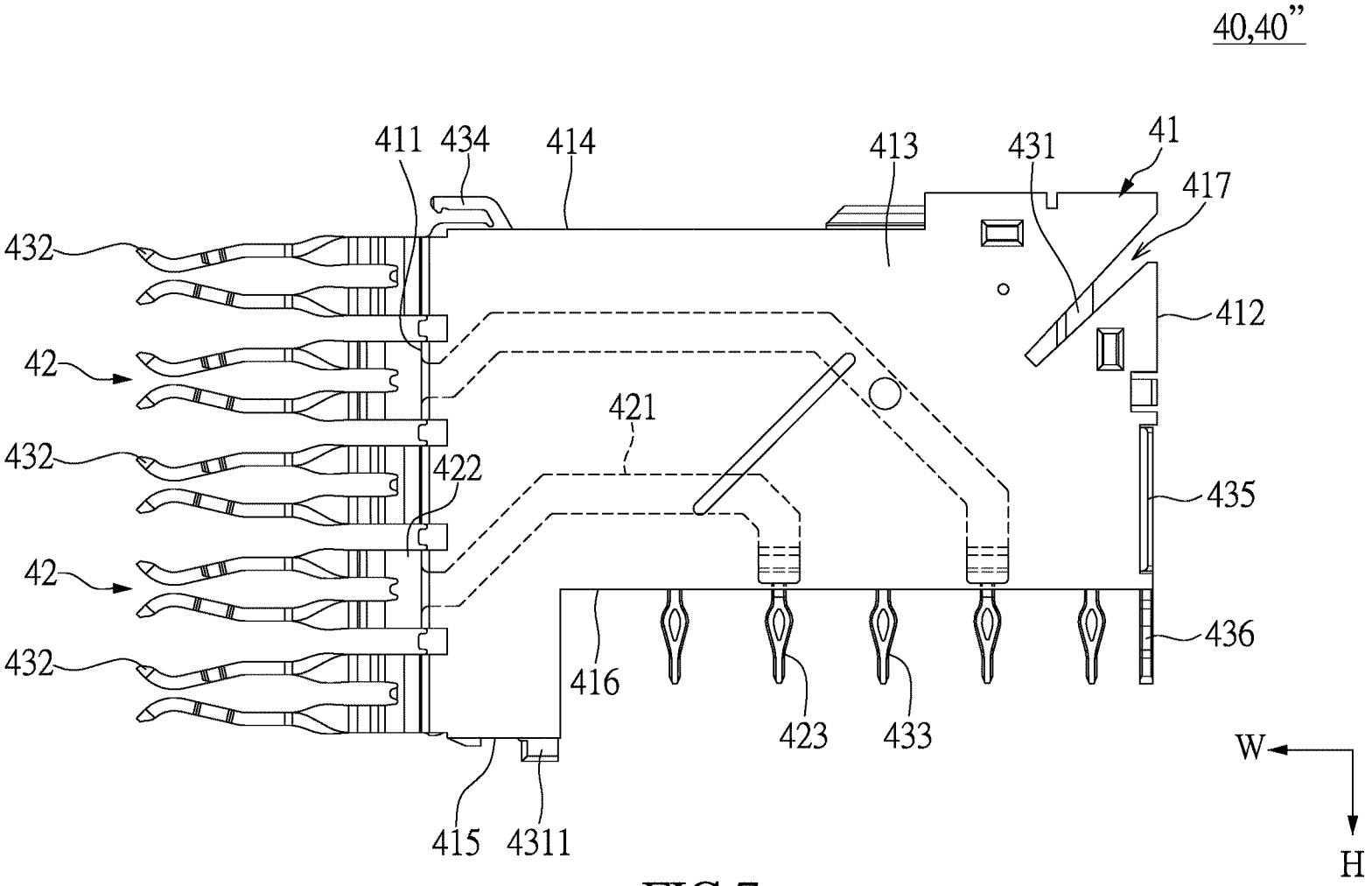
FIG. 7 is a plan view showing the other kind of differential signal wafers according to the instant disclosure.
Figure 8:
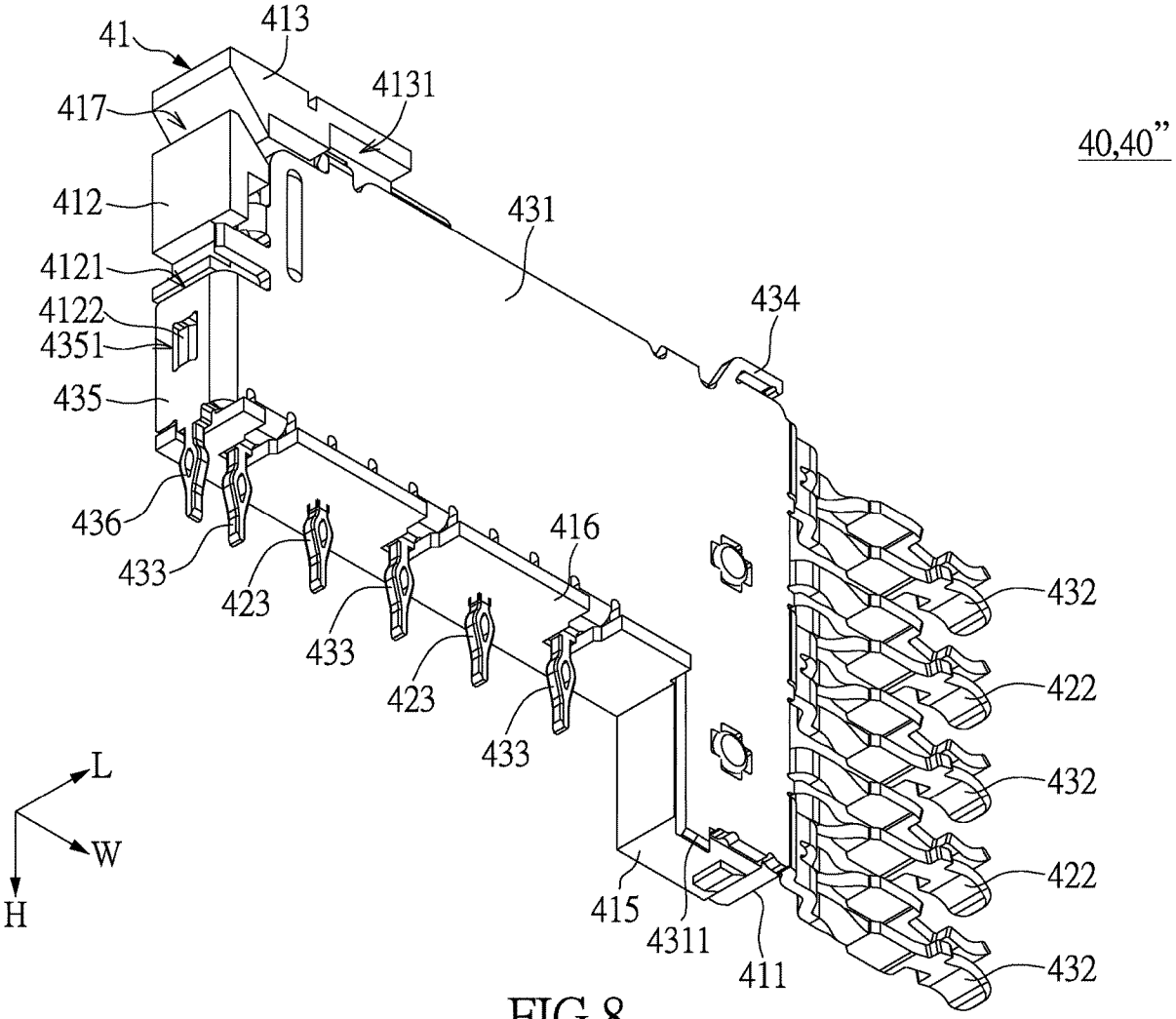
FIG. 8 is a perspective view of FIG. 7 from another perspective.

As shown in FIGS. 3 and 4, the insulating case 1 is an elongated structure and defines a length direction L, a height direction H, and a width direction W, which are perpendicular to each other. The insulating case 1 includes a receiving chamber 11, an accommodating slot 12 recessed on a top surface thereof, and a positioning plate 13 extended from the receiving chamber 11.

One side of the receiving chamber 11 (i.e., the front side of the receiving chamber 11 shown in FIG. 3) in the width direction W is configured to connect to a mating connector (not shown), the positioning plate 13 is extended from a top portion of the other side of the receiving chamber 11 (i.e., the rear side of the receiving chamber 11 shown in FIG. 3) in the width direction W, and a receiving slot 111 is formed on a bottom portion of the other side of the receiving chamber 11 (i.e., the rear side of the receiving chamber 11 shown in FIG. 3). A length of the receiving slot 111 in the length direction L is approximately equal to that of the differential signal assembly 4. The receiving chamber 11 has a plurality of grooves 112 recessed on the bottom portion thereof (shown in FIGS. 3 and 10). Moreover, the accommodating slot 12 is arranged on the top portion of the receiving chamber 11, and a length of the receiving slot 12 in the length direction L is approximately equal to that of the receiving chamber 11. A plurality of elongated guiding holes 14 are penetratingly formed from a bottom surface of the accommodating slot 12 to the positioning plate 13 in the width direction W. For each guiding hole 14, a width of a first portion of the guiding hole 14 formed on the accommodating slot 12 is greater than that of a second portion of the guiding hole 14 formed on positioning plate 13.

Figure 9:
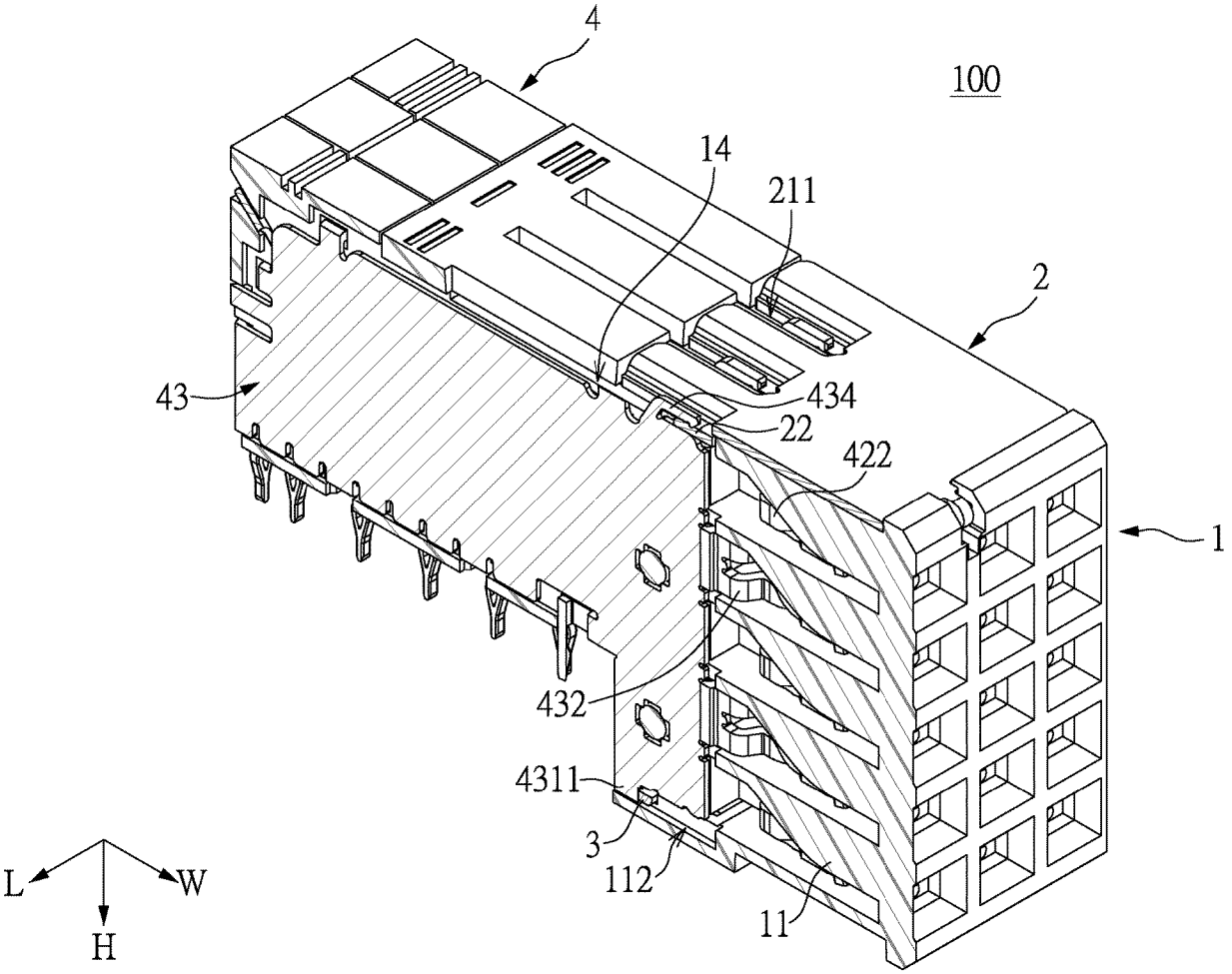
FIG. 9 is a cross-sectional view showing the electrical connector according to the instant disclosure.
Figure 10:
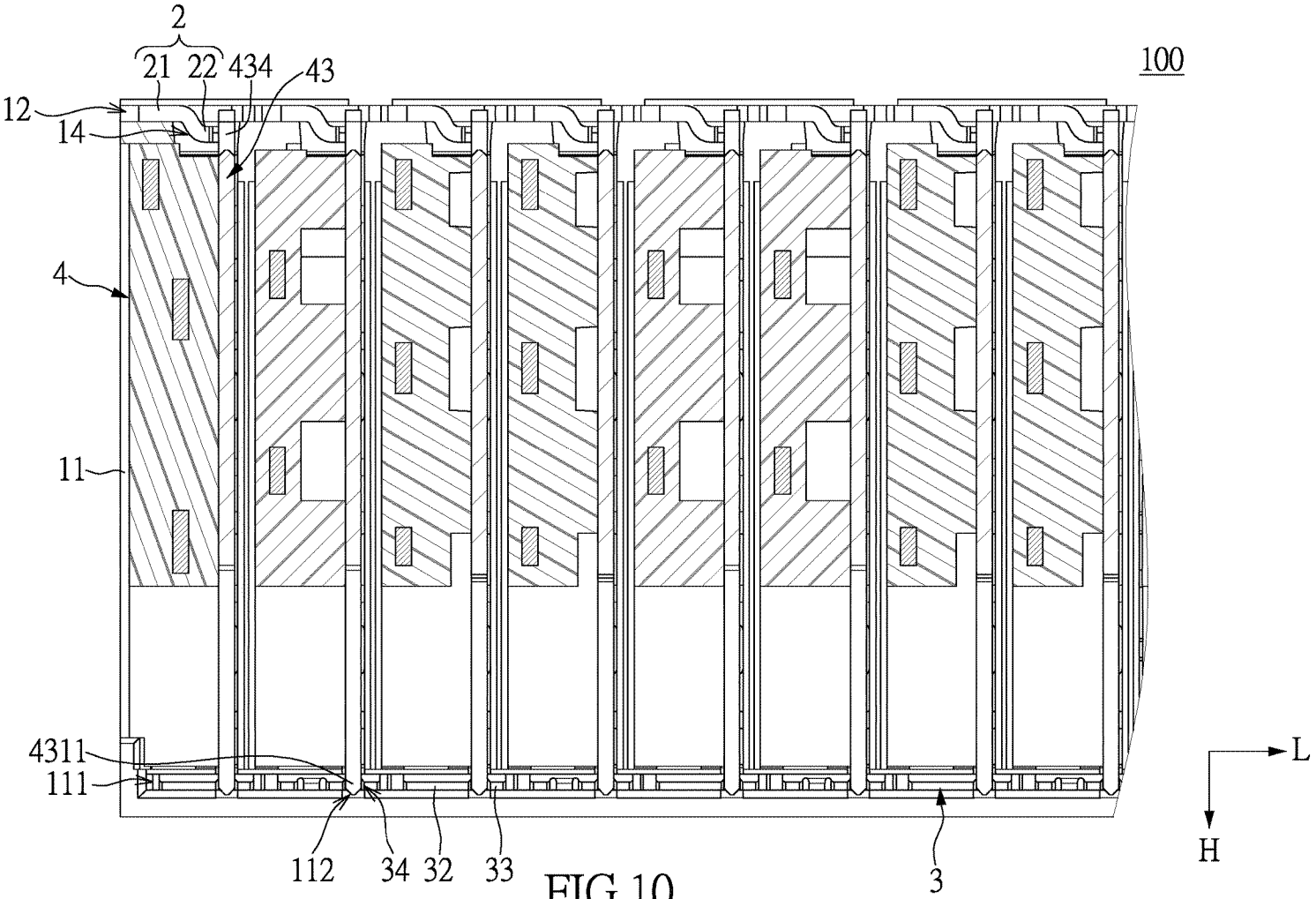
FIG. 10 is a cross-sectional view of FIG. 1 along a cross-sectional line X-X.

The shielding sheet 2 includes an elongated covering portion 21 disposed on the bottom of the accommodating slot 12 and a plurality of connecting portions 22 extended from the covering portion 21 to pass through the bottom surface of the accommodating slot 12 via the guiding holes 14 (as shown in FIG. 10). Specifically, a portion of the covering portion 21 corresponding to the differential signal assembly 4 in position and arranged adjacent to the positioning plate 13 includes a plurality of notches 211. The connecting portion 22 is extended from a side wall, which defines the notch 211, to the first portion of the guiding hole 14 in the length direction L (shown in FIGS. 9 and 10).

The beam 3 includes an elongated base portion 31, a plurality of abutting portions 32, and a plurality of elastic arms 33. The abutting portions 32 and the elastic arms 33 are extended from the base portion 31 and are alternated with each other. The elastic arms 33 are respectively cooperated with the abutting portions 32 to define a plurality of openings 34. The beam 3 is arranged in the receiving slot 111, and the openings 31 of the beam 3 are respectively corresponding in position to the grooves 112 (shown in FIG. 10).

The differential signal assembly 4 includes a plurality of pairs of differential signal wafers 40 arranged in one row parallel to the length direction L and installed to the insulating case 1. The differential signal assembly 4 includes at least two kinds of differential signal wafers 40 (i.e., a differential signal wafer 40' shown in FIG. 5 and a differential signal wafer 40" shown in FIG. 7). The following description discloses the common features of the differential signal wafers 40' and 40", but the common features do not limit the construction of each of the differential signal wafers 40' and 40".

As shown in FIGS. 5 through 8, the differential signal wafer 40 includes an insulating sheet 41, a plurality of terminals 42 fixed on the insulating sheet 41 by insert molding (or being inserted into the insulating sheet 41 directly in a non-shown embodiment), and a grounding sheet 43 detachably mounted on the insulating sheet 41. The outer surface of the insulating sheet 41 includes a front surface 411, a rear surface 412, two side surfaces 413, a top surface 414, a first bottom surface 415, and a second bottom surface 416. The front surface 411, the rear surface 412, the top surface 414, the first bottom surface 415, and the second bottom surface 416 are connected to the edges of the two side surfaces 413. A distance between the first bottom surface 415 and the top surface 414 is greater than a distance between the second bottom surface 416 and the top surface 414.

Moreover, the insulating sheet 41 includes a side slot 4131 recessed on one of the two side surfaces 413, a rear slot 4121 recessed on the rear surface 412 adjacent to the second bottom surface 416, a buckling block 4122 formed in the rear slot 4121, and a tilted slot 417 penetrating from one of the two side surfaces 413 to the other side surface 413. A distance between the tilted slot 417 and the front surface 411 is gradually increased or decreased in the height direction H. In the instant embodiment, the tilted slot 417 is recessed from a top portion of the rear surface 412 toward the second bottom surface 416. Thus, the distance between the tilted slot 417 and the front surface 411 is gradually decreased in a direction from the top surface 414 to the second bottom surface 416 (i.e., from top to bottom). In other words, the distance between the tilted slot 417 and the front surface 411 is gradually increased in a direction from the second bottom surface 416 to the top surface 414 (i.e., from bottom to top).

Each terminal 42 is an elongated and integral structure formed by punching a metallic plate (not shown). Each terminal 42 includes a main portion 421 embedded in the insulating sheet 41, a signal mating portion 422 extended from one end of the main portion 421 (i.e., the front end of the main portion 421 shown in FIG. 5 or FIG. 7), and a signal mounting portion 423 extended from the other end of the main portion 421 (i.e., the bottom end of the main portion 421 shown in FIG. 5 or FIG. 7). Each signal mounting portion 423 in the instant embodiment is a press-fit pin, but is not limited thereto. The signal mating portions 422 protrude from the front surface 411 of the insulating sheet 41, and the signal mounting portions 423 protrude from the second bottom surface 416 of the insulating sheet 41. A distance between a free end of each signal mounting portion 423 and the top surface 414 of the insulating sheet 41 is lesser than a distance between the first bottom surface 415 and the top surface 414 of the insulating sheet 41. Specifically, each signal mating portion 422 protrudes from the insulating sheet 41 in a first direction, and each signal mounting portion 423 protrudes from the insulating sheet 41 in a second direction perpendicular to the first direction, but the instant disclosure is not limited thereto. For example, in a non-shown embodiment, each signal mating portion 422 protrudes from the front surface 411 of the insulating sheet 41 in a first direction, and each signal mounting portion 423 protrudes from the rear surface 412 of the insulating sheet 41 in a second direction parallel to the first direction.

The grounding sheet 43 in the instant embodiment is an integrally metallic structure formed by the stamping machine and includes a main body 431 disposed in the side slot 4131 of the insulating sheet 41, a plurality of grounding mating portions 432 curvedly extended from one edge of the main body 431 (i.e., the front edge of the main body 431 shown in FIG. 6 or FIG. 8), a plurality of grounding mounting portions 433 curvedly extended from another edge of the main body 431 (i.e., the bottom edge of the main body 431 shown in FIG. 6 or FIG. 8), a connecting arm 434 connected to the main body 431, a shielding portion 435 connected to the main body 431, and a grounding pin 436 connected to the shielding portion 435.

The grounding mating portions 432 protrude from the front surface 411 of the insulating sheet 41, and the grounding mating portions 432 alternated with the signal mating potions 422 to arrange in one column parallel to the height direction H. The rear surface 412 of the insulating sheet 41 is arranged away from the grounding mating portions 432 and the signal mating potions 422. The grounding mounting portions 433 protrude from the second bottom surface 416 of the insulating sheet 41, and the grounding mounting portions 433 alternated with the signal mounting potions 423 to arrange in one column parallel to the width direction W.

Moreover, the connecting arm 434 is extended from a front portion of the top edge of the main body 431 (i.e., the upper right edge of the main body 431 shown in FIG. 6 or FIG. 8), which is away from the grounding mounting portions 433, and the connecting arm 434 protrudes from the top surface 414 of the insulating sheet 41. The main body 431 has a sheet-like protrusion 4311 arranged opposite to the connecting arm 434 in the height direction H, and the protrusion 4311 protrudes from the first bottom surface 415 of the insulating sheet 41.

The shielding portion 435 is perpendicularly extended from a lower half portion of a rear edge of the main body 431 (i.e., the lower left edge of the main body 431 shown in FIG. 6 or FIG. 8), which is away from the grounding mating portions 432, and the shielding portion 435 is disposed on the rear surface 412 of the insulating sheet 41. In the instant embodiment, the shielding portion 435 is arranged in the rear slot 4121 of the insulating sheet 41, and the shielding portion 435 has a hole 4351 to sleeve at the buckling block 4122 of the insulating sheet 41, but the instant disclosure is not limited thereto. The grounding pin 436, the grounding mounting portions 433, and the signal mounting portions 423 are arranged in one column parallel to the width direction W.

In addition, the shielding portion 435 in the instant embodiment is integrally extended from the main body 431, but is not limited thereto. In a non-shown embodiment, the shielding portion 435 can be separated from the main body 431 (e.g., the shielding portion 435 is not integrally extended from the main body 431) when satisfy the following circumstances that the shielding portion 435 be arranged on the rear surface 412 of the insulating sheet 41 and be electrically connected to the main body 431 of the grounding sheet 43.

Figure 11:
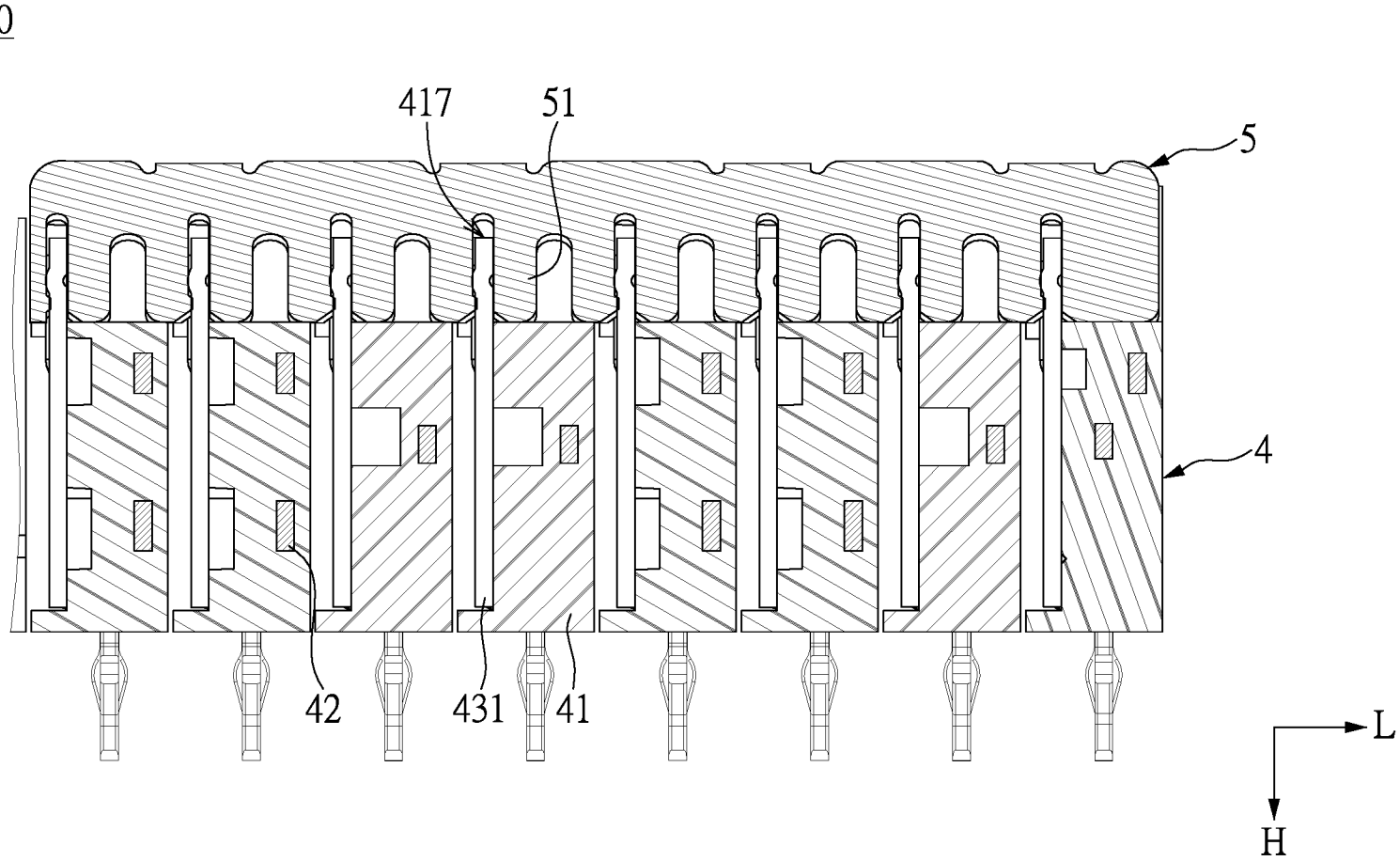
FIG. 11 is a cross-sectional view of FIG. 1 along a cross-sectional line XI-XI.
Figure 12:
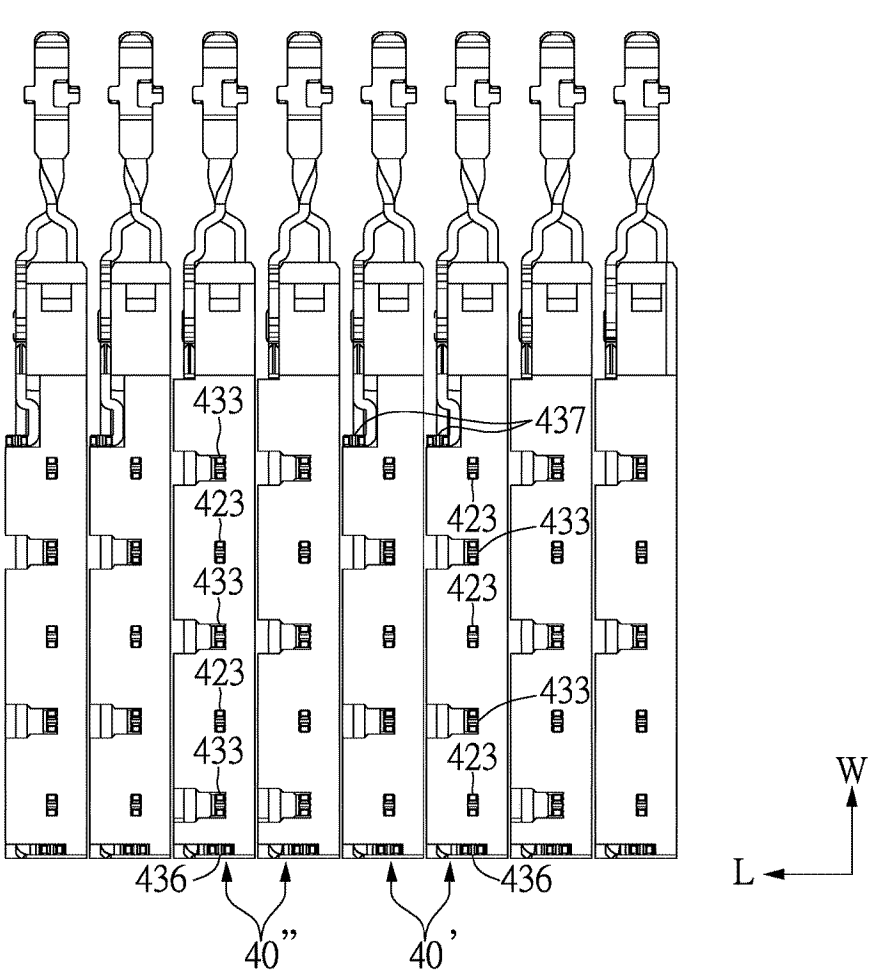
FIG. 12 is a bottom view showing a differential signal assembly of the electrical connector according to the instant disclosure.

As shown in FIGS. 9 through 11, the signal mating portions 422 and the grounding mating portions 432 of the differential signal assembly 4 are inserted into the receiving chamber 11 of the insulating case 1, the connecting arms 434 of the differential signal assembly 4 are respectively engaged with the connecting portions 22 of the shielding sheet 2, and the protrusions 4311 of the differential signal assembly 4 are respectively fixed in the openings 34 of the beam 3 and are respectively arranged in the grooves 112 of the receiving chamber 11. Thus, the signal mating portions 422 and the grounding mating portions 432 of the differential signal assembly 4 are shielded in the height direction H by the shielding sheet 2, and the shielding sheet 2 establishes a common-grounding loop by using the connecting arms 434 to connect the shielding sheet 2 with the grounding sheet 43. The beam 3 partially shields (the bottom side of) the terminals 42 of the differential signal assembly 4 in the height direction H, and the beam 3 establishes a common-grounding loop by using the protrusion 4311 to connect the beam 3 with the grounding sheets 43. The shielding portions 435 of the grounding sheets 43 partially shield (the rear side of) the terminals 42 of the differential signal assembly 4 in the width direction W (as shown in FIGS. 5 through 8).

Moreover, the bridge 5 is inserted into the insulating sheets 41 of the differential signal assembly 4. In each differential signal wafer 40, a portion of the main body 431 arranged opposite to the connecting arm 434 in the width direction W contacts the bridge 5, and the bridge 5 partially shields (the top side and the rear side of) the terminals 42 of the differential signal assembly 4 in the height direction H and the width direction W. Specifically, the bridge 5 is inserted into the tilted slots 417 of the differential signal wafers 40, and the bridge 5 includes a plurality of U-shaped clamping portions 51 respectively engaging the main bodies 431, thus bridge 5 can establish a common-grounding loop with the grounding sheets 43.

In summary, the main bodies 431 and the shielding portions 435 of the grounding sheets 43, the shielding sheet 2, the beam 3, and the bridge 5, which are connected to the grounding sheets 43, of the electrical connector 100 in the instant embodiment are configured to establish a grounding and shielding chamber (not labeled), so the terminals 42 of the differential signal wafers 40 can be covered more comprehensively by using the grounding and shielding chamber, and common-grounding loops can be established with the grounding sheets 43, thereby reducing a signal interference and improving a high-frequency transmitting efficiency.

Please refer to FIGS. 5 through 8, 12 and 13. The following description discloses two adjacent pairs of the differential signal wafers 40', 40". The signal mating portions 422 and the grounding mating portions 432 of each differential signal wafer 40', 40" are arranged in one column parallel to the height direction H (shown in FIGS. 6 and 8). The signal mounting portions 423 and the grounding mounting portions 433 of each differential signal wafer 40', 40" are arranged in one column parallel to the width direction W (shown in FIGS. 12 and 13).

As shown in FIGS. 5, 6, 12 and 13, this paragraph discloses the pair of the differential signal wafers 40'. The grounding sheet 43 of each differential signal wafer 40' includes a grounding pin 436 and an offset grounding pin 437, which are arranged at two opposite ends of the column of the mounting portions 423, 433. Each offset grounding pin 437 is curvedly extended from the corresponding main body 431 and has an offset with respect to the column of mounting portions 423, 433. The "offset" in the instant embodiment means that the offset grounding pin 437 is not arranged along the column of mounting portions 423, 433. Preferably, the offset grounding pin 437 is deviated from the column of mounting portions 423, 433 at forty-five degrees, but is not limited thereto. The two distal mounting portions 423 of each differential signal wafer 40' (i.e., the top mounting portion 423 and the bottom mounting portion 423 of each differential signal wafer 40' shown in FIG. 13) are two signal mounting portions 423 cooperating with the two signal mounting portions 423 of the other differential signal wafer 40' to transmit differential signal. Specifically, a single wafer (not shown) used for transmitting differential signal is different from any differential signal wafer 40' of the instant embodiment. That is to say, each differential signal wafer 40' of the instant embodiment excludes a single wafer (not shown) used for transmitting differential signal.

Figure 13:
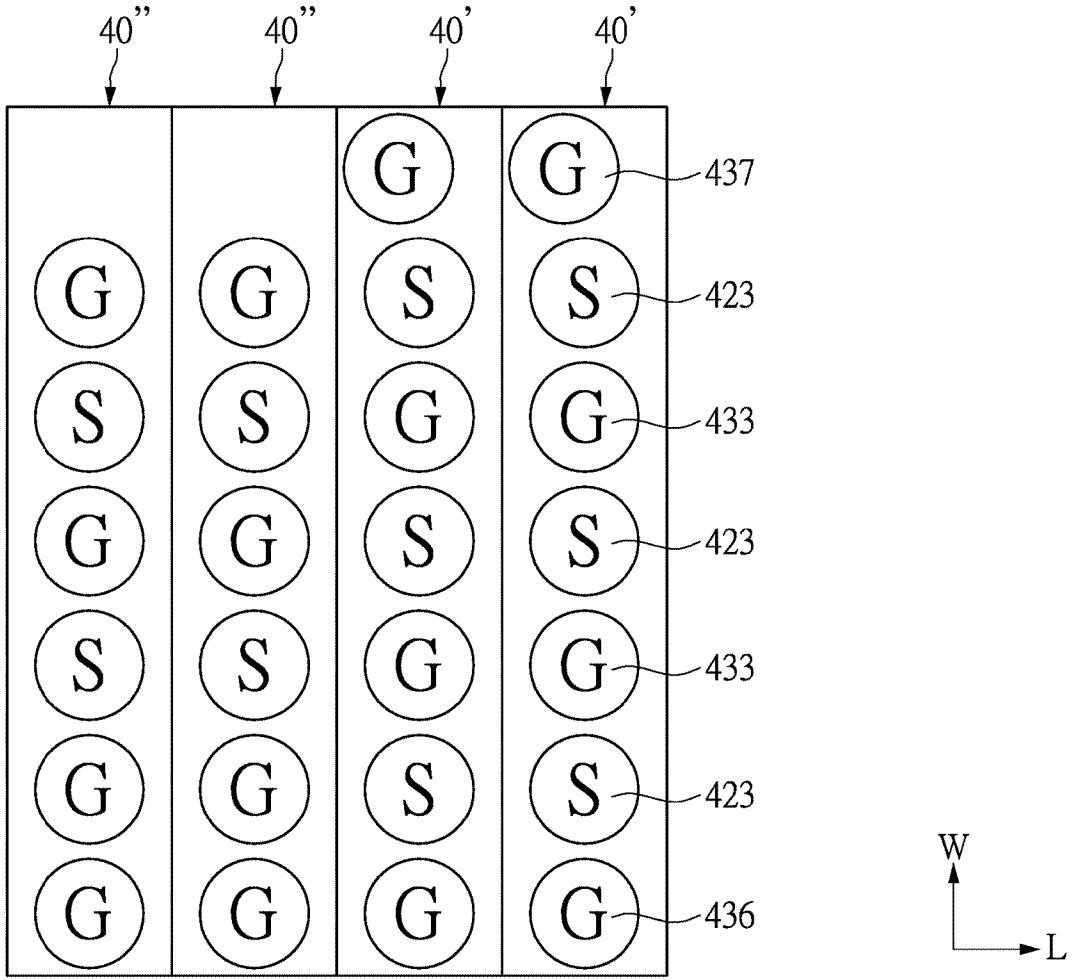
FIG. 13 is a schematic view showing the designation of two pairs of the differential signal wafers in the differential signal assembly.

As shown in FIGS. 7, 8, 12 and 13, for the pair of the differential signal wafers 40", the two distal mounting portions 433 of each differential signal wafer 40" (i.e., the top mounting portion 433 and the bottom mounting portion 433 of each differential signal wafer 40" shown in FIG. 13) are two grounding mounting portions 433. Moreover, in the two adjacent differential signal wafers 40', 40" arranged in the middle of the two pairs of the differential signal wafers 40', 40", the signal mounting portions 423 of one of the differential signal wafers 40', 40" are respectively arranged at one side of the grounding mounting portions 433 of the other differential signal wafer 40', 40", and each signal mounting portion 423 and the adjacent grounding mounting portion 433 are arranged in one row parallel to the length direction L.

Accordingly, the grounding pin 436 and the offset grounding pin 437 of the differential signal wafer 40' are configured to shield the two distal signal mounting portions 423 because the grounding pin 436 and the offset grounding pin 437 are arranged at two opposite sides of the column of the mounting portions 423, 433. Specifically, when the two distal signal mounting portions 423 of each differential signal wafer 40' and the two distal signal mounting portions 423 of the adjacent differential signal wafer 40' are coupling to transmit differential signal, the grounding pins 436 and the offset grounding pins 437 shield the distal signal mounting portions 423, thereby reducing a signal interference and improving a high-frequency transmitting efficiency.

Figure 14:
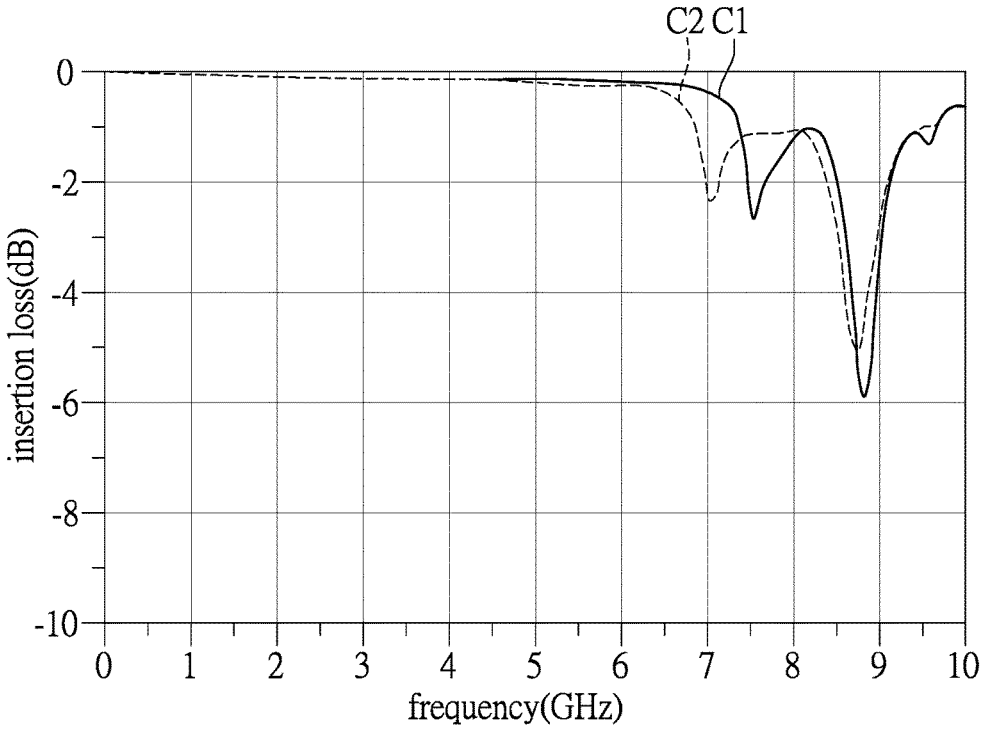
FIG. 14 is a simulating diagram showing the insertion loss of the electrical connector of the instant disclosure and the insertion loss of an electrical connector formed without an offset grounding pin.
Figure 15:
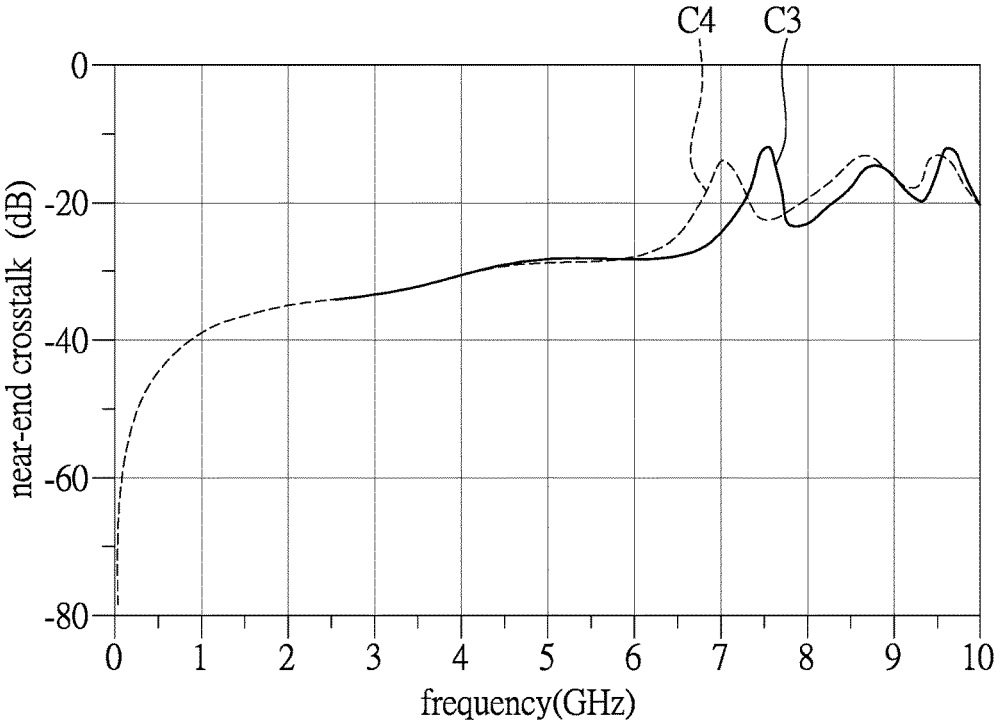
FIG. 15 is a simulating diagram showing the near-end crosstalk of the electrical connector of the instant disclosure and the near-end crosstalk of an electrical connector formed without an offset grounding pin.

Please refer to FIG. 14, which is a simulation diagram showing the insertion loss of the electrical connector 100 of the instant disclosure and the insertion loss of an electrical connector (not shown) formed without the offset grounding pin 437. The curved line C1 shows the simulating result of the electrical connector 100 of the instant embodiment, and the curved line C2 shows the simulating result of the electrical connector formed without the offset grounding pin 437. Comparing the curved lines C1, C2, the electrical connector 100 of the instant embodiment has a lower insertion loss. Moreover, please refer to FIG. 15, which is a simulation diagram showing the near-end crosstalk of the electrical connector 100 of the instant disclosure and the near-end crosstalk of an electrical connector (not shown) formed without the offset grounding pin 437. The curved line C3 shows the simulating result of the electrical connector 100 of the instant embodiment, and the curved line C4 shows the simulating result of the electrical connector formed without the offset grounding pin 437. Comparing the curved lines C3, C4, the electrical connector 100 of the instant embodiment has a lower near-end crosstalk.

As shown in FIGS. 3 and 4, the single-ended signal assembly 6 includes a plurality of single-ended signal wafers 60 arranged in one row with the differential signal assembly 4. Each single-ended signal wafer 60 includes an insulating portion 61 and a plurality of mating portions 62 protruding from the insulating portion 61. The mating portions 62 of the single-ended signal assembly 6 are inserted into the receiving chamber 11 of the insulating case 1, and at least part of the mating portions 62 of the single-ended signal assembly 6 are shielded by the shielding sheet 2 in the height direction H.

The Possible Effect of the Instant Embodiments

In summary, the signal mating portions and the grounding mating portions of the differential signal assembly are shielded in the height direction by connecting the shielding sheet to the connecting arms, and the shielding sheet establishes a common-grounding loop with the grounding sheets, thereby improving a high-frequency transmitting efficiency. Specifically, the main bodies and the shielding portions of the grounding sheets, the shielding sheet, the beam, and the bridge, which are connected to the grounding sheets, of the electrical connector in the instant embodiment are configured to establish a grounding and shielding chamber, so the terminals of the differential signal wafers can be covered more comprehensively by using the grounding and shielding chamber, thereby reducing a signal interference and improving high-frequency transmitting efficiency.

Moreover, the grounding pin and the offset grounding pin of the differential signal wafer are arranged at two opposite sides of the column of the mounting portions to shield the two distal signal mounting portions, such that when the two distal signal mounting portions of each differential signal wafer and the two distal signal mounting portions of the adjacent differential signal wafer are coupling to transmit differential signal, the grounding pins and the offset grounding pins shield the distal signal mounting portions, thereby reducing a signal interference and improving a high-frequency transmitting efficiency.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. An electrical connector, comprising:

an insulating case defining a length direction; and a differential signal assembly including two pairs of differential signal wafers arranged in one row parallel to the length direction, wherein the differential signal wafers are installed to the insulating case, and each differential signal wafer includes a plurality of mating portions inserted into the insulating case and a plurality of mounting portions arranged in one column;

wherein in one of the two pairs of differential signal wafers, each differential signal wafer includes an offset grounding pin arranged at one end of the column of mounting portions thereof and having an offset with respect to the column of mounting portions thereof, the two distal mounting portions of each differential signal wafer are defined as two signal mounting portions cooperating with the two signal mounting portions of the other differential signal wafer to transmit differential signal;

wherein in the other pair of differential signal wafers, the two distal mounting portions of each differential signal wafer are defined as two grounding mounting portions;

wherein in two adjacent differential signal wafers arranged in the middle of the two pairs of the differential signal wafers, the two signal mounting portions of one of the differential signal wafers are respectively arranged at one side of the two grounding mounting portions of the other differential signal wafer, and each signal mounting portion and the adjacent grounding mounting portion are arranged in one row parallel to the length direction.

2. The electrical connector as claimed in claim 1, wherein the mating portions of each differential signal wafer are defined as a plurality of signal mating portions and a plurality of grounding mating portions alternated with respect to the signal mating portions, the mounting portions of each differential signal wafer are defined as a plurality of signal mounting portions and a plurality of grounding mounting portions alternated with respect to the signal mounting portions, wherein each differential signal wafer comprises:

an insulating sheet;

a plurality of terminals including a plurality of main portions embedded in the insulating sheet, the signal mating portions respectively extended from one end of the main portions, and the signal mounting portions respectively extended from the other end of the main portions; and a grounding sheet including a main body disposed on a side of the insulating sheet, the grounding mating portions connected to one end of the main body, and the grounding mounting portions connected to another end of the main body; wherein the grounding mating portions and the signal mating portions are arranged in one column parallel to a height direction perpendicular to the length direction.

3. The electrical connector as claimed in claim 1, further comprising a shielding sheet disposed on an outer surface of the insulating case for shielding the mating portions in the height direction.

4. The electrical connector as claimed in claim 1, wherein each differential signal wafer includes a grounding pin arranged close to the other end of the column of the mounting portions thereof, and the grounding pin and the mating portions of each differential signal wafer are arranged in one column.

5. The electrical connector as claimed in claim 2, further comprising a shielding sheet disposed on an outer surface of the insulating case, wherein the signal mating portions and the grounding mating portions of the differential signal assembly are inserted into the insulating case and are shielded in the height direction by the shielding sheet.

6. The electrical connector as claimed in claim 5, wherein each grounding sheet includes a connecting arm connected to the main body, and the connecting arms of the differential signal assembly are detachably abutted against the shielding sheet.

7. The electrical connector as claimed in claim 6, wherein the insulating case has an accommodating slot recessed on a top surface thereof, the shielding sheet includes a covering portion disposed on a bottom surface of the accommodating slot and a plurality of connecting portions extended from the covering portion to pass through the bottom surface of the accommodating slot, and the connecting arms are respectively engaged with the connecting portions.

8. The electrical connector as claimed in claim 2, wherein in each differential signal wafer, a surface of the insulating sheet arranged away from the signal mating portions and the grounding mating portions is defined as a rear surface, the grounding sheet includes a shielding portion extended from an end of the main body away from the grounding mating portions, and the shielding portion is disposed on the rear surface.

9. The electrical connector as claimed in claim 8, wherein each differential signal wafer includes a grounding pin arranged close to the other end of the column of mounting portions thereof.

10. The electrical connector as claimed in claim 9, wherein in each differential signal wafer, the grounding pin is extended from the shielding portion in the height direction, and the grounding pin and the mounting portions are arranged in one column.

11. The electrical connector as claimed in claim 2, further comprising a beam arranged in the insulating case, wherein in each differential signal wafer, the main body has a protrusion arranged opposite to the connecting arm in the height direction contacting with the beam.

12. The electrical connector as claimed in claim 11, wherein the beam includes a base portion, a plurality of abutting portions, and a plurality of elastic arms, wherein the abutting portions and the elastic arms are alternated with each other and are extended from the base portion, the elastic arms are respectively cooperated with the abutting portions to define a plurality of openings, and the protrusions are respectively inserted into the openings.

13. The electrical connector as claimed in claim 2, further comprising a bridge inserted into the insulating sheets, wherein the insulating case defines a width direction perpendicular to the length direction and the height direction; wherein in each differential signal wafer, a portion of the main body arranged opposite to the connecting arm in the width direction contacts the bridge.

14. The electrical connector as claimed in claim 13, wherein the bridge includes a plurality of clamping portions respectively engaging the main bodies.

15. The electrical connector as claimed in claim 13, wherein in each differential signal wafer, the signal mating portions protrudes from a front surface of the insulating sheet, the insulating sheet has a tilted slot, and a distance between the tilted slot and the front surface is gradually increased or decreased in the height direction; wherein the bridge is inserted into the tilted slots of the differential signal wafers.

16. The electrical connector as claimed in claim 5, further comprising a single-ended signal assembly including a plurality of single-ended signal wafers arranged in one row with the differential signal assembly, wherein each single-ended signal wafer includes an insulating portion and a plurality of mating portions protruding from the insulating portion, wherein the mating portions of the single-ended signal assembly are inserted into the insulating case, and at least part of the mating portions of the single-ended signal assembly are shielded by the shielding sheet.

17. A differential signal assembly of an electrical connector, comprising: two pairs of differential signal wafers arranged in one row parallel to a length direction, wherein each differential signal wafer includes a plurality of mating portions arranged in column parallel to a height direction perpendicular to the length direction and a plurality of mounting portions arranged in one column parallel to a width direction perpendicular to the length direction and the height direction;

wherein in one of the two pairs of differential signal wafers, each differential signal wafer includes an offset grounding pin arranged at one end of the column of mounting portions thereof and having an offset with respect to the column of mounting portions thereof, the two distal mounting portions of each differential signal wafer are defined as two signal mounting portions cooperating with the two signal mounting portions of the other differential signal wafer to transmit differential signal;

wherein in the other pair of differential signal wafers, the two distal mounting portions of each differential signal wafer are defined as two grounding mounting portions;

wherein in two adjacent differential signal wafers arranged in middle of the two pairs of the differential signal wafers, the two signal mounting portions of one of the differential signal wafers are respectively arranged at one side of the two grounding mounting portions of the other differential signal wafer, and each signal mounting portion and the adjacent grounding mounting portion are arranged in one row parallel to the length direction.

18. The differential signal assembly of the electrical connector as claimed in claim 17, wherein each differential signal wafer includes a grounding pin arranged close to the other end of the column of mounting portions thereof, and the grounding pin and the mating portions are arranged in one column.

19. The differential signal assembly of the electrical connector as claimed in claim 17, wherein the offset grounding pin is deviated from the column of mounting portions at forty-five degrees.

20. The differential signal assembly of the electrical connector as claimed in claim 17, wherein each differential signal wafer comprises:

an insulating sheet;

a plurality of terminals including a plurality of main portions embedded in the insulating sheet, part of the mating portions respectively extended from one end of the main portions, and part of the mounting portions respectively extended from the other end of the main portions; and a grounding sheet including a main body disposed on a side of the insulating sheet, wherein the other part of the mating portions are connected to one end of the main body, and the other part of the mounting portions are connected to another end of the main body.

* * * * *